US009484194B2

(12) United States Patent
Brown et al.

(10) Patent No.: US 9,484,194 B2
(45) Date of Patent: Nov. 1, 2016

(54) CONTROLLING HYDROGEN-DEUTERIUM EXCHANGE ON A SPECTRUM BY SPECTRUM BASIS

(75) Inventors: Jeffery Mark Brown, Hyde (GB); Steven Derek Pringle, Darwen (GB); Keith Richardson, High Peak (GB)

(73) Assignee: Micromass UK Limited, Wilmslow (GB)

( * ) Notice: Subject to any disclaimer, the term of this patent is extended or adjusted under 35 U.S.C. 154(b) by 208 days.

(21) Appl. No.: 13/885,913

(22) PCT Filed: Nov. 16, 2011

(86) PCT No.: PCT/GB2011/052237

§ 371 (c)(1),
(2), (4) Date: Jul. 31, 2013

(87) PCT Pub. No.: WO2012/066329

PCT Pub. Date: May 24, 2012

(65) Prior Publication Data

US 2015/0034813 A1 Feb. 5, 2015

Related U.S. Application Data

(60) Provisional application No. 61/421,377, filed on Dec. 9, 2010.

(30) Foreign Application Priority Data

Nov. 16, 2010 (GB) ..... 1019337.3

(51) Int. Cl.

| | |
|---|---|
| ***H01J 49/00*** | (2006.01) |
| ***H01J 49/06*** | (2006.01) |
| ***H01J 49/26*** | (2006.01) |

(52) U.S. Cl.
CPC ..... *H01J 49/0077* (2013.01); *H01J 49/00* (2013.01); *H01J 49/0031* (2013.01);
(Continued)

(58) Field of Classification Search
CPC .. H01J 49/00; H01J 49/0031; H01J 49/0036; H01J 49/0054; H01J 49/0072; H01J 49/0077; H01J 49/06; H01J 49/065; H01J 49/26; G06K 9/0057
See application file for complete search history.

(56) References Cited

U.S. PATENT DOCUMENTS 6,054,709 A * 4/2000 Douglas ..... H01J 49/0431 250/282
6,982,414 B2 * 1/2006 Bateman ..... H01J 49/0031 250/281

(Continued)

FOREIGN PATENT DOCUMENTS

GB 2392303 A * 2/2004
JP 2003/529044 9/2003

(Continued)

*Primary Examiner* — Wyatt Stoffa
(74) *Attorney, Agent, or Firm* — Diederiks & Whitelaw, PLC

(57) ABSTRACT

A mass spectrometer is disclosed comprising a liquid chromatography device for separating ions. A gas phase ion-neutral reaction device is arranged downstream to perform a gas phase ion-neutral reaction such as Hydrogen-Deuterium exchange. A control system is arranged to automatically and repeatedly switch the reaction device back and forth between a first mode of operation and a second mode of operation, wherein in the first mode of operation at least some parent or precursor ions are caused to react within the reaction device and wherein in the second mode of operation substantially fewer or no parent or precursor ions are caused to react.

16 Claims, 6 Drawing Sheets

(52) U.S. Cl.
CPC ..... *H01J 49/0036* (2013.01); *H01J 49/0054* (2013.01); *H01J 49/0072* (2013.01); *H01J 49/06* (2013.01); *H01J 49/065* (2013.01); *H01J 49/26* (2013.01)

(56) References Cited

U.S. PATENT DOCUMENTS

| | | | | |
|---|---|---|---|---|
| 7,759,638 | B2 | 7/2010 | Makarov et al. | |
| 7,759,641 | B2 | 7/2010 | Hasegawa et al. | |
| 8,283,626 | B2 * | 10/2012 | Brown | H01J 49/0072 250/281 |
| 8,410,437 | B2 | 4/2013 | Brown et al. | |
| 2004/0007666 | A1 * | 1/2004 | Griffey | H01J 49/0077 250/282 |
| 2006/0151689 | A1 * | 7/2006 | Bateman | H01J 49/0031 250/288 |
| 2007/0084998 | A1 * | 4/2007 | Franzen | H01J 49/004 250/287 |
| 2008/0224033 | A1 * | 9/2008 | Makarov | H01J 49/04 250/287 |
| 2010/0108878 | A1 * | 5/2010 | Bateman | G01N 27/622 250/283 |
| 2010/0267148 | A1 * | 10/2010 | Blanksby | H01J 49/0045 436/71 |
| 2011/0042565 | A1 * | 2/2011 | Bateman | G01N 27/622 250/287 |
| 2011/0062324 | A1 * | 3/2011 | Bateman | H01J 49/0031 250/288 |
| 2011/0114835 | A1 | 5/2011 | Chen et al. | |
| 2011/0121170 | A1 * | 5/2011 | Park | G01N 27/622 250/282 |
| 2011/0215237 | A1 * | 9/2011 | Bateman | H01J 49/0031 250/282 |
| 2012/0032073 | A1 * | 2/2012 | Rand | H01J 49/0077 250/282 |
| 2012/0231486 | A1 * | 9/2012 | Lavold | G01N 30/7266 435/23 |
| 2013/0206974 | A1 * | 8/2013 | Brown | H01J 49/0077 250/282 |
| 2014/0048700 | A1 * | 2/2014 | Whitehouse | G01N 30/7266 250/282 |
| 2014/0110576 | A1 * | 4/2014 | Chen | H01J 49/0072 250/282 |
| 2014/0117221 | A1 * | 5/2014 | Schneider | G01N 27/622 250/282 |

FOREIGN PATENT DOCUMENTS

| | | |
|---|---|---|
| JP | 2010/523135 | 7/2010 |
| WO | 03091720 | 11/2003 |
| WO | 2009/146345 | 12/2009 |

* cited by examiner

Intensity
%
100
0
m/z
432
433
434
435
436
437
438
439
440
432.95
433.29
433.62
433.95
434.29
432.96
433.29
433.62
433.96
434.29
432.14
435.98
436.30
436.64
436.98
437.31
435.64
435.30
434.97
434.63
3 Da 100
%
0
0.38
0.52
0.70
0.88
0.98
1.16
1.30
1.45
10
12
14
16
18
20
22
24
26
28
30
32
34
36
38
40
42
44

100
%
0
0.48
0.63
0.77
0.95
1.05
1.23
1.34
1.52
10
12
14
16
18
20
22
24
26
28
30
32
34
36
38
40
42
44

CONTROLLING HYDROGEN-DEUTERIUM EXCHANGE ON A SPECTRUM BY SPECTRUM BASIS

CROSS-REFERENCE TO RELATED APPLICATION

This application represents a National Stage application of PCT/GB2011/052237 entitled "Controlling Hydrogen-Deuterium Exchange on a Spectrum by Spectrum Basis" filed 16 Nov. 2011 which claims priority from and the benefit of U.S. Provisional Patent Application Ser. No. 61/421,377 filed on 9 Dec. 2010 and United Kingdom Patent Application No. 1019337.3 filed on 16 Nov. 2010. The entire contents of these applications are incorporated herein by reference.

BACKGROUND TO THE INVENTION

The present invention relates to a mass spectrometer and a method of mass spectrometry.

The conformations of biomolecules (including proteins and peptides) depend strongly upon intra-molecular non-covalent interactions. These interactions determine, at a molecular level, a vast majority of biological processes (e.g. molecular recognition, regulation, transport, etc.) that control the function(s) of the bio-molecule.

With the increased interest in using biomolecules as pharmaceutical treatments there is a growing necessity, as a quality control, to determine that a synthesised bio-molecule is not only correct in terms of its components but also correct in terms of its conformation or shape.

Anal. Chem. 2009, 81, 10019-10028 discloses gas-phase hydrogen/deuterium exchange in a travelling wave ion guide.

It is desired to provide an improved mass spectrometer and method of mass spectrometry.

SUMMARY OF THE INVENTION

According to an aspect of the present invention there is provided a mass spectrometer comprising:

a first device for separating ions;

a second device arranged to perform a gas phase ion-neutral reaction arranged downstream of the first device;

a control system for controlling the second device; and a mass analyser;

wherein:

the control system is arranged and adapted to automatically and repeatedly switch the second device back and forth between a first mode of operation and a second mode of operation, wherein in the first mode of operation at least some parent or precursor ions are caused to react within the second device and wherein in the second mode of operation substantially fewer or no parent or precursor ions are caused to react.

According to another aspect of the present invention there is provided a mass spectrometer comprising:

a first device for separating ions;

a second device arranged to perform a gas phase ion-neutral reaction arranged downstream of the first device;

a control system for controlling the second device; and a mass analyser;

wherein:

the control system is arranged and adapted to automatically and repeatedly switch the mass spectrometer back and forth between a first mode of operation and a second mode of operation, wherein in the first mode of operation at least some parent or precursor ions are caused to react within the second device and wherein in the second mode of operation parent or precursor ions are caused to by-pass the second device.

The second device is preferably arranged and adapted to perform gas phase hydrogen-deuterium exchange.

In the first mode of operation at least some of the parent or precursor ions are preferably caused to become deuterated within the second device and wherein in the second mode of operation substantially fewer or no parent or precursor ions are caused to become deuterated.

The mass spectrometer preferably further comprises a device for supplying a reagent gas or vapour to the second device and wherein the reagent gas or vapour is preferably selected from the group consisting of: (i) deuterated ammonia or $ND_3$; (ii) deuterated methanol or $CD_3OD$; (iii) deuterated water or $D_2O$; and (iv) deuterated hydrogen sulphide or $D_2S$.

The second device may be arranged and adapted to perform ozonolysis.

The control system is preferably arranged and adapted either to switch the second device or the mass spectrometer back and forth between the first and second modes operation at least once every 0.1, 0.2, 0.3, 0.4, 0.5, 0.6, 0.7, 0.8, 0.9, 1, 2, 3, 4, 5, 6, 7, 8, 9 or 10 seconds.

The first device may comprise a liquid chromatography or capillary electrophoresis device.

The second device may be selected from the group consisting of:

(i) an ion tunnel or ion funnel device comprising a plurality of electrodes each comprising an aperture or forming an ion guide region through which ions are transmitted in use;

(ii) a multipole rod set device; or (iii) a plurality of planar electrodes arranged in a plane in which ions are generally transmitted through the device.

The second device may comprise a plurality of electrodes and wherein one or more transient DC voltages or waveforms are applied to the electrodes.

According to an embodiment in the first mode of operation the control system may be arranged and adapted to set the amplitude and/or speed at which the one or more transient DC voltages or waveforms are applied to the electrodes so that the average residence time of parent or precursor ions within the second device is T1; and wherein in the second mode of operation the control system is arranged and adapted to set the amplitude and/or speed at which the one or more transient DC voltages or waveforms are applied to the electrodes so that the average residence time of parent or precursor ions within the second device is T2, wherein T2<T1.

The control system is preferably arranged and adapted:

(i) to cause parent or precursor ions which have undergone a reaction in the second device and which emerge from the second device in the first mode of operation to be mass analysed by the mass analyser to form a first mass spectrum or first mass spectral data;

(ii) to cause parent or precursor ions which have not undergone a reaction in the second device and which emerge from the second device in the second mode of operation to be mass analysed by the mass analyser to form a second mass spectrum or second mass spectral data; and (iii) to compare the first mass spectrum or first mass spectral data with the second mass spectrum or second mass spectral data.

The mass spectrometer may further comprise a fragmentation device arranged downstream of the second device, wherein the fragmentation device is arranged and adapted to fragment ions emerging from the second device in the first mode of operation and/or the second mode of operation.

The fragmentation device may comprise an Electron Transfer Dissociation ("ETD") fragmentation device, an Electron Capture Dissociation ("ECD") fragmentation device or a Collision Induced Dissociation ("CID") fragmentation device.

The control system is preferably arranged and adapted:

(i) to cause deuterated fragment ions which emerge from the fragmentation device to be mass analysed by the mass analyser to form a third mass spectrum or third mass spectral data;

(ii) to cause non-deuterated fragment ions which emerge from the fragmentation device to be mass analysed by the mass analyser to form a fourth mass spectrum or fourth mass spectral data; and (iii) to compare the third mass spectrum or third mass spectral data with the fourth mass spectrum or fourth mass spectral data.

The control system is preferably arranged and adapted:

(i) to correlate deuterated parent or precursor ions with corresponding non-deuterated parent or precursor ions on the basis of their LC elution time and/or their ion mobility drift time; and/or (ii) to correlate deuterated fragment ions and/or non-deuterated fragment ions with corresponding deuterated parent or precursor ions and/or non-deuterated parent or precursor ions on the basis of their LC elution time and/or their ion mobility drift time.

According to an aspect of the present invention there is provided a method of mass spectrometry comprising:

separating ions in a first device;

performing a gas phase ion-neutral reaction on the ions in a second device arranged downstream of the first device;

mass analysing the ions;

wherein the method further comprises:

automatically and repeatedly switching the second device back and forth between a first mode of operation and a second mode of operation, wherein in the first mode of operation at least some parent or precursor ions are caused to react within the second device and wherein in the second mode of operation substantially fewer or no parent or precursor ions are caused to become react.

According to aspect of the present invention there is provided a method of mass spectrometry comprising:

separating ions in a first device;

performing a gas phase ion-neutral reaction on the ions in a second device arranged downstream of the first device;

mass analysing the ions;

wherein the method further comprises:

automatically and repeatedly switch the mass spectrometer back and forth between a first mode of operation and a second mode of operation, wherein in the first mode of operation at least some parent or precursor ions are caused to react within the second device and wherein in the second mode of operation parent or precursor ions are caused to by-pass the second device.

The method preferably further comprises switching between the first mode of operation and the second mode of operation at least once every 0.1, 0.2, 0.3, 0.4, 0.5, 0.6, 0.7, 0.8, 0.9, 1, 2, 3, 4, 5, 6, 7, 8, 9 or 10 seconds.

According to an aspect of the present invention there is provided a mass spectrometer comprising:

a gas phase ion-neutral reaction device; and a control system for controlling the gas phase ion-neutral reaction device;

wherein:

the control system is arranged and adapted to automatically and repeatedly vary the residence time of ions within the gas phase ion-neutral reaction device so that in a first mode of operation ions are arranged to have a relatively long average residence time T1 within the gas phase ion-neutral reaction device and wherein in the second mode of operation ions are arranged to have a relatively short or zero residence time T2 within the gas phase ion-neutral reaction device.

The gas phase ion-neutral reaction device preferably comprises a hydrogen-deuterium exchange device or an ozonolysis device.

In the first mode of operation the ions preferably become deuterated and wherein in the second mode of operation the ions preferably remain undeuterated.

The control system is preferably arranged and adapted to switch between the first mode of operation and the second mode of operation at least once every 0.1, 0.2, 0.3, 0.4, 0.5, 0.6, 0.7, 0.8, 0.9, 1, 2, 3, 4, 5, 6, 7, 8, 9 or 10 seconds.

According to an aspect of the present invention there is provided a method of mass spectrometry comprising:

performing gas phase ion-neutral reactions on ions in a gas phase ion-neutral reaction device;

wherein the method further comprises:

automatically and repeatedly varying the residence time of ions within the gas phase ion-neutral reaction device so that in a first mode of operation ions are arranged to have a relatively long average residence time T1 within the gas phase ion-neutral reaction device and wherein in the second mode of operation ions are arranged to have a relatively short or zero residence time T2 within the gas phase ion-neutral reaction.

Hydrogen deuterium exchange is a chemical reaction wherein a covalently bonded hydrogen atom is replaced by a deuterium atom.

According to the preferred embodiment an LC or other separation device (e.g. ion mobility separator) is coupled to a mass spectrometer and accurate retention time (or drift time) measurements are preferably used, alternating between non-exchanging and hydrogen/deuterium exchanging conditions on a spectrum to spectrum basis, in an analogous manner to "Shotgun" techniques such as "$MS^E$" wherein a large number of parent or precursor ions are simultaneously fragmented and their product ions recorded.

Product ions which have been subject to hydrogen/deuterium exchange are preferably associated with corresponding parent or precursor ions according to the closeness of alignment of their LC elution (and/or ion mobility drift) times. According to the preferred embodiment deconvolution of hydrogen/deuterium exchange data may be greatly simplified as any exchanged ion which has been subject to hydrogen/deuterium exchange will share the same or substantially similar retention (drift) time as its corresponding precursor or parent ion. In addition to modifying parent or precursor ions using hydrogen/deuterium exchange, the precursor or parent ions and the hydrogen/deuterium exchange product ions may further be subjected to dissociation.

It is known that Collision Induced Dissociation ("CID") introduces so called "scrambling" whereby during the CID process deuterium atoms which have exchanged with hydrogen atoms in the parent or precursor ions will become "mobile" due to "heating" of the ion as a result of the CID process. As a result, the position/location of the deuterium atoms on or along the length of the precursor ion may change. It has been recently postulated that the lower energy processes associated with Electron Transfer Dissociation ("ETD") do not suffer from this limitation and hence the location of exchanged deuterium atoms will remain fixed. Therefore, ETD is viewed as being particularly advantageous in that it allows the location of exchanged ions to be determined and is a further diagnostic for the conformation of an analysed biomolecule (and/or protein or peptide). Nevertheless, data produced using CID still remains useful for fingerprinting and other analyses.

The preferred embodiment relates to methods which significantly enhance the acquisition of LC MS data allowing the improved determination of bio-molecule, protein and peptide conformations within a mass spectrometer by utilising gas phase hydrogen-deuterium exchange ("HDx"). By utilising accurate retention time measurements and alternating between non-exchanging and exchanging conditions on a spectrum to spectrum basis the deconvolution of hydrogen/deuterium exchange data is significantly simplified, as any exchanged ion will share the same elution time as its precursor ion in an analogous manner to Shotgun techniques. In addition, when coupled with fragmentation on alternating scans, the location of the exchanged/exposed hydrogen atoms on the bio-molecule, protein or peptide may be determined more easily.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
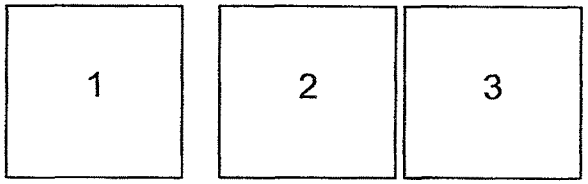
FIG. 1 shows an embodiment of the present invention comprising a separation device, a hydrogen-deuterium exchange device arranged downstream of the separation device and a mass analyser arranged downstream of the hydrogen-deuterium exchange device.

FIG. 1 shows a schematic of a preferred embodiment of the present invention comprising a separation device 1, a hydrogen-deuterium exchange device 2 arranged downstream of the separation device 1 and a mass analyser 3 arranged downstream of the hydrogen-deuterium exchange device 2. The separation device 1 preferably comprises a means of ionising a sample and introducing ions into a mass spectrometer. The hydrogen-deuterium exchange device 2 is preferably capable of performing gas phase hydrogen-deuterium exchange and preferably includes a means of enabling and disabling the hydrogen-deuterium exchange. For example, according to the preferred embodiment the hydrogen-deuterium exchange device 2 may comprise an ion tunnel ion guide comprising a plurality of electrodes each having an aperture through which ions are transmitted in use. One or more transient DC voltages or voltage waveforms may be applied to the electrodes of the hydrogen-deuterium exchange device 2. The amplitude and/or velocity of the travelling wave voltage may be controlled so as to enable and/or disable hydrogen-deuterium exchange from occurring. An analytical mass analyser 3 is preferably provided downstream of the hydrogen-deuterium exchange device 2.

In a preferred embodiment the separation device 1 preferably comprises a liquid chromatography ("LC") or nano-LC system and preferably includes an ESI/nano or ESI ion source and an Atmospheric Pressure Ionisation ("API") inlet. In an alternative embodiment the separation device 1 may comprise an ion mobility separator. According to another less preferred embodiment the separation device 1 may comprise a quadrupole mass analyser or a linear ion trap. Other less preferred separation techniques are also contemplated.

In a preferred embodiment hydrogen/deuterium exchange is preferably performed within a hydrogen-deuterium exchange device 2 which preferably comprises a stacked ring ion guide comprising a plurality of electrodes each having an aperture through which ions are transmitted in use. A travelling wave or one or more transient DC voltages or transient DC voltage waveforms is preferably applied to the electrodes of the stacked ring ion guide in order to urge ions along at least part of the length of the ion guide. When a relatively high voltage pulse (e.g. 5 to 10 V) is applied to the electrodes using a default travelling wave velocity of 300 m/s then ions are preferably prevented from rolling over the top of the travelling wave. As a result, the ion residence time within the ion guide is relatively short and hence hydrogen-deuterium exchange within the ion guide is effectively disabled since the ion residence time is too short for hydrogen-deuterium exchange to occur.

According to an embodiment hydrogen/deuterium exchange may be enabled by reducing the amplitude of the travelling wave to a relatively low voltage (e.g. ≤0.2 V or 0 V). This has the effect of effectively switching OFF the travelling wave voltage and hence the ion residence time increases allowing hydrogen-deuterium exchange to occur.

According to another embodiment, the amplitude of the travelling wave may be kept constant and hydrogen/deuterium exchange may be controlled by controlling the velocity of the travelling wave. For example, if the amplitude of the travelling wave is set at an intermediate level and the pulse velocity is set very high (e.g. 600 m/s to 1000 m/s) then ions may simply rollover the travelling wave. As a result, the ion residence time is then relatively long and hydrogen-deuterium exchange is enabled. Hydrogen-deuterium exchange may be disabled by setting the pulse velocity to be relatively slower (e.g. 80 m/s to 300 m/s). At lower pulse velocities the ions may be caught by the travelling wave and urged along the length of the ion guide. As a result, the ion residence time is relatively short and hydrogen-deuterium exchange is preferably disabled.

In other less preferred embodiments hydrogen/deuterium exchange may be performed within an ion guide and the residence time of ions passing through the device may be controlled by other methods.

According to an embodiment the hydrogen-deuterium exchange device may comprise a segmented multipole device and an axial driving field (DC or pseudo-potential) may be used to urge ions along and through the length of the ion guide.

In a preferred embodiment a hydrogen/deuterium exchange reagent gas or vapour such as $ND_3$, $CD_3OD$, $D_2O$ or $D_2S$ may be provided within the ion guide or hydrogen-deuterium exchange device.

In a preferred embodiment the analytical mass analyser 3 may comprise a Time of Flight mass analyser or a Fourier Transform electrostatic trap (such as an Orbitrap®). In other less preferred embodiments other types of mass analyser may be used.

According to the preferred embodiment alternate mass spectra are preferably acquired wherein the hydrogen/deuterium exchange device 2 is preferably arranged to be switched ON and OFF between an exchanging and a non-exchanging mode of operation. The resulting mass spectra are preferably deconvoluted using their elution profiles.

In an embodiment the deconvolution may be performed using a computer algorithm such as "BayesSpray" to automate and improve the process of matching the hydrogen/deuterium exchange product ions to corresponding precursor or parent ions. The algorithm has previously been used for, and is particularly suited to, deconvoluting complex mixtures of precursor analytes and MS/MS fragments.

BayesSpray is a Bayesian Markov chain Monte Carlo deconvolution algorithm for mass spectrometry data and the algorithm is described in GB1008542.1 filed 21 May 2010 the contents of which are incorporated into the present application. For each isotopic cluster of peaks, the total signal associated with each level of deuteration is reconstructed and therefore significantly simplifies the data. By associating precursor or parent ions to product ions based on chromatographic retention time the degree of deuterium uptake is then directly depicted. This automated process of deconvolution is preferably used to generate a characteristic list (or "fingerprint") of precursor or parent ions and the pattern of deuteration for each precursor or parent ion. In addition, the degree of deuteration of each precursor or parent ion is recorded. Various hydrogen/deuterium exchange specific modifications to BayesSpray (including direct modelling of deuteration) enable the speed of deconvolution and/or the quality of the results obtained in a fixed processing time to be improved.

In other embodiments other deconvolution techniques may be used.

Figure 2:
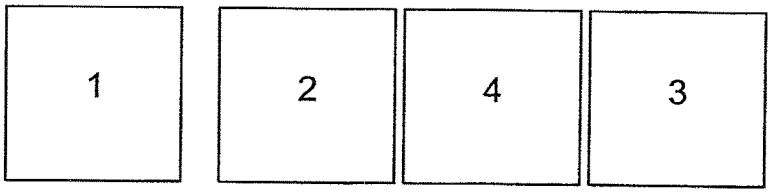
FIG. 2 shows an embodiment of the present invention comprising a separation device, a hydrogen-deuterium exchange device arranged downstream of the separation device, a fragmentation device arranged downstream of the hydrogen-deuterium exchange device and a mass analyser arranged downstream of the fragmentation device.

FIG. 2 shows a schematic of another embodiment of the present invention wherein a fragmentation device 4 is provided downstream of the hydrogen-deuterium exchange device 2 and upstream of the mass analyser 3. The fragmentation device 4 preferably comprises an Electron Transfer Dissociation ("ETD" or "nETD") device or less preferably an Electron Capture Dissociation ("ECD") device. In other embodiments the fragmentation device 4 may comprise a Collision Induced Dissociation ("CID") device. In a preferred embodiment ETD or CID may performed within a travelling wave enabled stacked ring ion guide as described, for example, in WO 2009/066089. In other less preferred embodiments fragmentation may be induced in an alternative type of ion guide such as a multipole ion guide.

The system preferably has a four spectrum cycle: (i) parent ion scan i.e. hydrogen/deuterium exchange disabled, fragmentation disabled; (ii) deuterated parent ion scan i.e. hydrogen/deuterium exchange enabled, fragmentation disabled; (iii) fragment ion scan i.e. hydrogen/deuterium exchange disabled, fragmentation enabled; and finally (iv) deuterated fragment ion scan i.e. hydrogen/deuterium exchange enabled, fragmentation enabled. The resulting mass spectra are preferably deconvoluted and fragment ions are preferably assigned to precursor or parent ions using their elution profiles.

Figure 3:
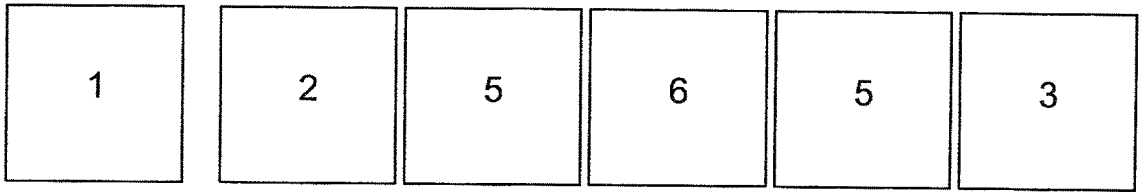
FIG. 3 shows an embodiment of the present invention comprising a separation device, a hydrogen-deuterium exchange device, a multi-mode HDx device (which may be operated in either a HDx, ETD or CID mode of operation), an IMS device (which may be operated in either an IMS, CID or ion guide mode of operation), a further multi-mode HDx device (which may be operated in either a HDx, ETD or CID mode of operation), and a mass analyser.

A further embodiment of the present invention is shown in FIG. 3 and extends the previous embodiments with the provision of two multi-mode HDx devices 5 arranged either side of a multi-mode ion mobility separator device 6.

The multi-mode HDx devices 5 preferably comprise an ion guide which may be operated either as hydrogen-deuterium exchange device, an ETD device or a CID device.

The multi-mode ion mobility separator device 6 preferably comprises an ion guide which may be operated either an ion mobility separator, a CID fragmentation device or as an ion guide.

In a preferred embodiment the two multi-mode HDx devices 5 and/or the ion mobility separator device 6 comprise travelling wave enabled stacked ring ion guides, although other geometries are contemplated. According to an embodiment HDx may be performed in the hydrogen-deuterium exchange device 2, followed by ETD in the first multi-mode HDx device 5, followed by ion mobility separation ("IMS") in the ion mobility separation device 6, followed by CID in the second multi-mode HDx device 5. Deconvolution is preferably performed based upon both LC retention time and ion mobility drift time.

Clearly one skilled in the art may construct other advantageous geometries without detracting from the scope of this invention.

Figure 4:
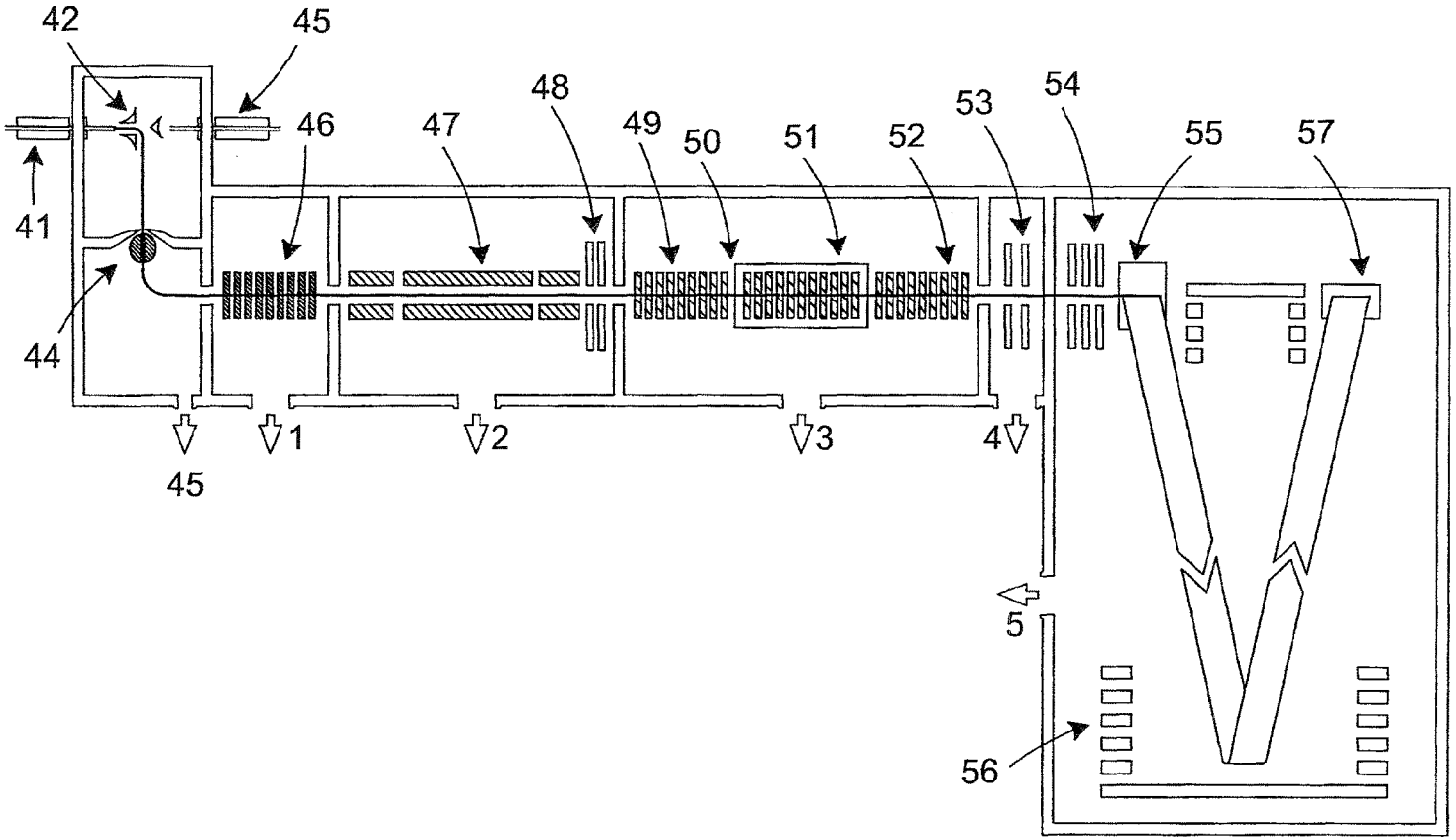
FIG. 4 shows a modified quadrupole Time of Flight mass analyser which was used to obtain hydrogen-deuterium exchange data.

Experimental data was generated on a modified Waters Synapt® hybrid quadrupole Time of Flight mass spectrometer as shown in FIG. 4. The mass spectrometer comprises an analyte spray 41, a lockspray baffle 42 and a lockmass reference spray 43. Ions pass via an isolation valve and removable sample cone 44 into a vacuum chamber pumped by an oil-free scroll pump 45. The ions then pass to a T-wave ion guide 46 housed in a downstream vacuum chamber pumped by an air-cooled turbomolecular pump. The ions then pass to a downstream vacuum chamber housing a quadrupole 47 and a Dynamic Range Enhancement ("DRE") lens 48. This vacuum chamber is also pumped by an air-cooled turbomolecular pump. The ions then pass into a further vacuum chamber housing a T-Wave Trap 49, a T-Wave Ion Mobility Separator ("IMS") device 51 having an ion gate 50 and a downstream T-Wave transfer ion guide 52. This vacuum chamber is also pumped by an air-cooled turbomolecular pump. The ions then pass through a short vacuum chamber housing an Einzel lens 53. The vacuum chamber is pumped by an air-cooled turbomolecular pump. Finally, the ions arrive in a vacuum chamber housing a Time of Flight mass analyser and which is also pumped by an air-cooled turbomolecular pump. The ions pass through transfer lenses 54 and are then orthogonally accelerated by a pusher electrode 55 into a time of flight or drift region. The ions are reflected by a reflectron 56 back towards an ion detector 57.

The mass spectrometer was modified by the addition of a gas inlet needle valve connected to the source ion guide gas inlet allowing the introduction of fully deuterated ammonia ($ND_3$) into the T-Wave ion guide 46 which is arranged upstream of a quadrupole rod set mass filter 47.

When the needle valve was closed so that deuterated ammonia was not introduced into the travelling wave ion guide 46 then the pressure in the travelling ion guide 46 was $1.40\times10^{-3}$ mbar.

When $ND_3$ was introduced into the travelling wave ion guide 46 then the indicated pressure in the travelling wave ion guide 46 was $1.42\times10^{-3}$ mbar.

Angiotensin I (Asp-Arg-Val-Tyr-Ile-His-Pro-Phe-His-Leu ($C_{62}H_{89}N_{17}O_{14}$)) was ionised using a standard ESI probe and triply charged precursor or parent ions having a mass to charge ratio of 432.9 were monitored.

Figures 5A, 5B, 5C:
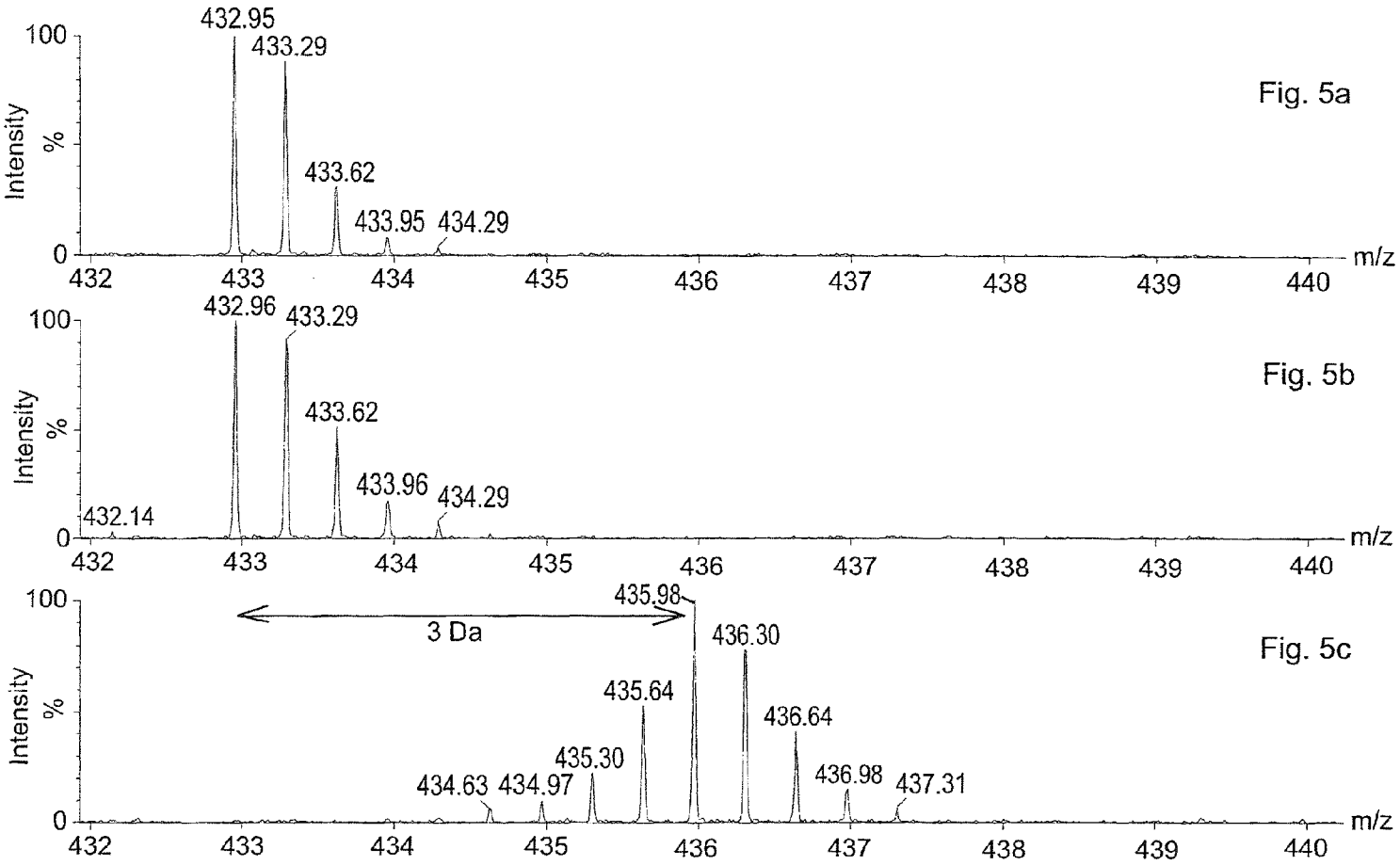
FIG. 5A shows a mass spectrum of parent ions having a mass to charge ratio of 432.9 when the parent ions were not subjected to hydrogen-deuterium exchange.
FIG. 5B shows a mass spectrum wherein parent ions were translated through an ion guide comprising deuterated ammonia by applying a travelling wave voltage to the electrodes of the ion guide and wherein the velocity and pulse height of the travelling wave voltage was set such that the residence time of the parent ions was relatively short and FIG. 5C shows a corresponding mass spectrum wherein the amplitude of the travelling wave voltage was reduced to zero so that the residence time of the parent ions was relatively long.

A mass spectrum of Angiotensin I was obtained under normal conditions (i.e. without introducing $ND_3$ into the source travelling wave ion guide 46) and is shown in FIG. 5A.

FIG. 5B shows a corresponding mass spectrum obtained by admitting $ND_3$ into the travelling wave ion guide 46 and setting the travelling wave velocity of the travelling wave applied to the ion guide 46 at 86 m/s with a pulse voltage height of 4.5 V. The pulse voltage height was such that ions were transmitted through the travelling wave ion guide 46 and had a relatively short residence time within the travelling wave ion guide 46. As a result hydrogen-deuterium exchange was effectively disabled.

FIG. 5C shows a corresponding mass spectrum which was obtained wherein hydrogen-deuterium exchange was effectively enabled. Hydrogen-deuterium exchange was enabled by reducing the pulse height of the travelling wave voltage applied to the travelling wave ion guide 46 to 0 V. This had the effect of switching the travelling wave OFF thereby increasing the ion residence time within the travelling wave ion guide 46 which then acted as a hydrogen-deuterium exchange device.

From comparing FIGS. 5A-5C it is apparent from FIG. 5B that there is minimal uptake of deuterium when the travelling wave had a relatively high pulse height of 4.5 V. However, as is apparent from FIG. 5C, when the travelling wave was effectively switched OFF to enable hydrogen-deuterium exchange to occur, the increased reaction or residence time resulted in an average of nine hydrogen atoms (3 Da shift) being exchanged with deuterium.

Figures 6A, 6B:
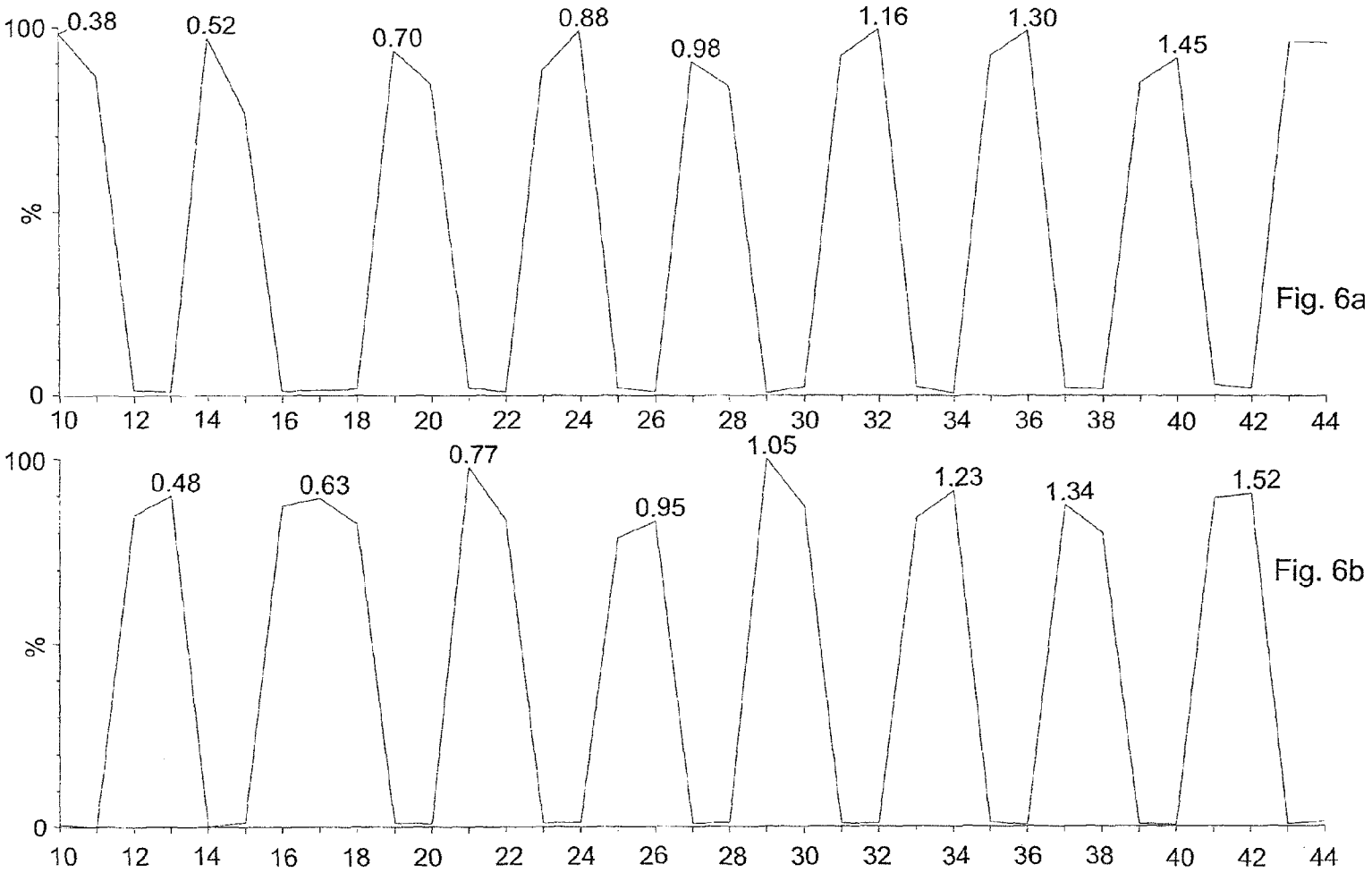
FIG. 6A shows a reconstructed mass chromatogram of non-deuterated parent ions and FIG. 6B shows a reconstructed mass chromatogram of corresponding deuterated hydrogen/deuterium exchange species ions wherein the amplitude of the travelling wave voltage applied to the ion guide was reduced to zero every two scans.

FIGS. 6A and 6B show reconstructed mass chromatograms of non-deuterated and hydrogen/deuterium exchange species respectively showing that hydrogen/deuterium exchange can be controlled on a spectrum by spectrum basis. In FIGS. 6A and 6B, the travelling wave pulse voltage was switched between 4.5 V (hydrogen-deuterium exchange disabled) and 0 V (hydrogen-deuterium exchange enabled) every two scans.

Although the preferred embodiment has been described as relating to Hydrogen-Deuterium exchange wherein gas phase ions react with neutral gas, the present invention is also intended to cover other gas phase ion-neutral reactions including ozonolysis.

BayesSpray

Mass spectrometers can be used for many applications including identification, characterisation and relative and absolute quantification of proteins, peptides, oligonucleotides, phosphopeptides, polymers and fragments or a mixture of these produced inside the mass spectrometer. One of the current limiting factors in the generation of these results is the analysis of the raw data produced from the mass spectrometer—in particular, the isolation and mass measurement of species present in complicated mass spectra.

The data produced by mass spectrometers are complicated due to the ionisation process, the presence of isotopes and the individual characteristics of each instrument.

Current methods for the analysis of raw data produced from mass spectrometers include maximum entropy deconvolution and various algebraic techniques based on inversion, usually by a linear filter.

In attempting to deconvolute the data, linear inversion sharpens individual peaks, which has the unfortunate side effect of introducing "ringing" which damages the reconstruction of complex spectra containing many overlapping peaks. The peaks interfere with each other, and the ringing is liable to produce physically-impossible regions of negative intensity.

Maximum entropy (see "Disentangling electrospray spectra with maximum entropy", Rapid Communications in Mass Spectrometry, 6, 707-711) is a nonlinear maximisation inversion, designed to produce an optimal "best possible" result from the given data. In spectrometry, the natural measure of quality of a reconstructed mass spectrum I(M) is the entropy:

$$\text{entropy}=-\int I(M)\log I(M)dM$$

Being negative information, this measures the cleanliness of the result, which result (because of the logarithm) is everywhere positive and so physically permissible. Any spectrum I* other than the maximum entropy spectrum $I^{MaxEnt}$ has more structure, which by definition was not required by the data, so is unreliable.

Modern professional standards demand quantified error bars that are produced from probabilistic (aka Bayesian) analysis. In order to understand exactly which parts of the maximum entropy result are reliable and which may be unreliable, one needs not just "the best" but also the range of the plausible. To estimate uncertainty, quadratic expansion around the maximum entropy result yields a Gaussian approximation which appears to define the uncertainty on any specified feature. This approach has been implemented but the expansion is deceptive.

Many modern instruments produce high resolution spectra which may be digitised into a correspondingly large number N of bins. As the quality of instrumentation improves, N increases, so that the proportion of signal in any particular bin diminishes as 1/N. The same is true for the variances produced by the quadratic approximation. Hence the size of the error bars around the maximum entropy result decreases more slowly, as the square root of 1/N. The reconstructed signal in a local bin that started comfortably positive as (3±1) percent becomes, at hundred-fold greater resolution, (0.03±0.1) percent, with a substantial probability of being negative. Across the entire spectrum, it becomes almost certain that there will be many negatives in a typical result. But signals are supposed to be positive, so almost all supposedly typical results are impossible when viewed on small scales.

Thus the quadratic approximation breaks down at small scales, where error bars are clearly incorrect so that local structure is not properly quantified. There is therefore a need for an improved deconvolution method with the rigour, power and flexibility to deal with modern instrument performance and applications.

A method of identifying and/or characterising at least one property of a sample is disclosed, the method comprising the steps of producing at least one measured spectrum of data from a sample using a mass spectrometer; deconvoluting the at least one measured spectrum of data by Bayesian inference to produce a family of plausible deconvoluted spectra of data; inferring an underlying spectrum of data from the family of plausible deconvoluted spectra of data; and using the underlying spectrum of data to identify and/or characterise at least one property of the sample.

The method may also comprise the step of identifying the uncertainties associated with underlying spectrum of data, e.g. from the family of plausible deconvoluted spectra of data.

Additionally or alternatively, the deconvolution step may further comprise assigning a prior, for example using a procedure that may comprise one or more, for example at least two steps. The procedure may comprise first assigning a prior to the total intensity and then, for example, modifying the prior to encompass the relative proportions of this total intensity that is assigned to specific charge states.

Optionally, the deconvolution step may further comprise the use of a nested sampling technique.

The procedure may comprise varying predicted ratios of isotopic compositions, for example to identify and/or characterise the at least one property of the sample.

The method may further comprise comparing at least one characteristic of the underlying spectrum of data, e.g. with a library of known spectra, for example to identify and/or characterise the at least one property of the sample.

The method may also comprise comparing at least one characteristic of the underlying spectrum of data, for example with candidate constituents, e.g. to identify and/or characterise the at least one property of the sample.

The deconvolution step comprises the use of importance sampling.

Optionally, the at least one measured spectrum of data may comprise electrospray mass spectral data.

The method may further comprise recording a temporal separation characteristic for the at least one measured spectrum of data and/or may include storing the underlying spectrum of data, e.g. with the recorded temporal separation characteristic, for example on a memory means.

The method may also comprise recording a temporal separation characteristic for the at least one measured spectrum of data, e.g. and using the recorded temporal separation characteristic, for example to identify and/or characterise the or a further at least one property of the sample.

A system for identifying and/or characterising a sample is disclosed, the system comprising: a mass spectrometer for producing at least one measured spectrum of data from a sample; a processor configured or programmed or adapted to deconvolute the at least one measured spectrum of data by Bayesian inference to produce a family of plausible deconvoluted spectra of data and infer an underlying spectrum of data from the family of plausible deconvoluted spectra of data; wherein the processor is further configured or programmed or adapted to use the underlying spectrum of data to identify and/or characterise at least one property of the sample.

The system may further comprise a first memory means for storing the underlying spectrum of data and/or a second memory means on which is stored a library of known spectra. The processor may be further configured or programmed or adapted to carry out a method as described above.

A computer program element is disclosed, for example comprising computer readable program code means, e.g. for causing a processor to execute a procedure to implement the method described above.

The computer program element may be embodied on a computer readable medium.

A computer readable medium having a program stored thereon is disclosed, for example where the program is to make a computer execute a procedure, e.g. to implement the method described above.

A mass spectrometer suitable for carrying out, or specifically adapted to carry out, a method as described above and/or comprising a program element as described above a computer readable medium as described above is disclosed.

A retrofit kit for adapting a mass spectrometer to provide a mass spectrometer as described above is disclosed. The kit may comprise a program element as described above and/or a computer readable medium as described above.

A method and apparatus for the deconvolution of mass spectral data is provided. This method preferably uses Bayesian Inference implemented using nested sampling techniques in order to produce improved deconvoluted mass spectral data.

Bayesian inference is the application of standard probability calculus to data analysis, taking proper account of uncertainties.

Bayesian inference does not provide absolute answers. Instead, data modulate our prior information into posterior results. Good data is sufficiently definitive to over-ride prior ignorance, but noisy or incomplete data is not. To account for this, the rules of probability calculus require assignment of a prior probability distribution over a range sufficient to cover any reasonable result. A mass range within which the target masses must lie might be specified, and, less obviously, information about how many target masses are reasonable could be provided.

Prior information must be specified in enough detail to represent expectations about what the target spectrum—in the preferred embodiment a spectrum of parent masses—might be, before the data are acquired. One specifies an appropriate range of targets T through a probability distribution:

$$\text{prior}(T)=\text{prior probability of target } T$$

known in Bayesian parlance as "the prior".

There is a huge number of possible targets, depending on how many masses may be present, and the myriad different values those masses and their associated intensities could take. Practical instrumentation usually has a few more calibration parameters as well, which adds to the uncertainty in the target. Nevertheless, it is assumed that the instrument can be modelled well enough that average data (known as mock data) can be calculated for any proposed target (and any proposed calibration). Actual data will be noisy, and won't fit the mock data exactly. The noise is part of the presumed-known instrumental characteristics, so that the misfit between actual and mock data lets us calculate, as a probability, how likely the actual data were. This probability is known as "the likelihood":

$$L\text{hood}(T)=\text{Prob(actual data } D \text{ GIVEN proposed target } T)$$

which is the other half of the Bayesian inputs (the other being the prior).

The product law of probability calculus then gives a joint distribution:

$$\underbrace{Prob(D\ AND\ T)}_{Joint(T)} = \underbrace{Prob(T)}_{prior(T)} \times \underbrace{Prob(D\ GIVEN\ T)}_{Lhood(T)}$$

In the presence of complicated data, the possibility of processing the joint distribution through algebraic manipulation rapidly fades, so that it needs to be computed numerically as an ensemble of typically a few dozen plausible targets $T_1, T_2, \ldots, T_n$, accompanied by weights $w_1, w_2, \ldots, w_n$ that need not be uniform.

Methods which yield these weighted ensembles are required. These methods will provide the joint distribution.

Using the probability product law the other way round gives the Bayesian outputs:

$$\underbrace{Prob(D\ AND\ T)}_{Joint(T)} = \underbrace{Prob(D)}_{Evidence} \times \underbrace{Prob(T\ GIVEN\ D)}_{Posterior(T)}$$

The "evidence" measures how well the prior model managed to predict the actual data, which assesses the quality of the model against any alternative suggestions. It is evaluated as the sum of the weights. The "posterior" is the inference about what the target was—which is usually the user's primary aim. It is evaluated as the ensemble of plausible targets, weighted by the relative w's.

The joint distribution thus includes both halves, evidence and posterior, of Bayesian inference. Nested sampling is the preferred method for the computation of this distribution.

It is easy to take random samples from the prior alone, ignoring the data. Each sample target has its likelihood value, so in principle it might be possible to find the good targets of high likelihood by taking random proposals. The difficulty is that there is too much choice. Suppose a mass spectrum has 100 lines each located to 100 ppm (1 in 10000 accuracy). Only one trial in $10000^{100}=10^{400}$ will get to the right answer. Obviously, computing $10^{400}$ samples would be prohibitively time consuming and is therefore impractical.

That example illustrates that the posterior is exponentially tighter than the prior. Every relevant bit of data halves the number of plausible results, so compresses by a factor of 2. Although the number of relevant bits may be considerably less than the size of the (somewhat redundant) dataset, it is still likely to be hundreds or thousands. To accomplish exponential compression, it is essential to bridge iteratively from prior to posterior. A single step can compress by O(1), say a factor of 2, without undue inefficiency, so that the required compression can be achieved in a feasible number (say hundreds or thousands) of iterations.

The required deconvolution is preferably of electrospray mass spectrometry data. In this case, the data is complicated by the presence of variable charge attached to each target mass. Nested Sampling enables the required probability computation to be accomplished, even in the face of the extra uncertainty of how the signals from each parent mass are distributed over charge.

Nested Sampling (see "Nested sampling for general Bayesian computation", Journal of Bayesian Analysis, 1, 833-860 (2006)) is an inference algorithm specifically designed for large and difficult applications. In mass spectrometry, iteration is essential because single-pass algorithms are inherently incapable of inferring a spectrum under the nonlinear constraint that intensities must all be positive. Nested-sampling iterations steadily and systematically extract information (also known as negative entropy) from the data and yield mass spectra with ever-closer fits.

Although capable of proceeding to a final "maximum likelihood" solution, the algorithm is in practice stopped when it has acquired enough information to define the distribution of spectra that are both intrinsically plausible and offer a probabilistically correct fit to the data. After all, any single solution would be somehow atypical, whereas professional standards demand that results are provided with proper estimates of the corresponding uncertainties, which can only be achieved through the ensemble.

Although nested sampling can in principle cope with arbitrary likelihood and arbitrary prior, it remains advantageous to choose an appropriate prior (the likelihood function being fixed by the responses as specified by the equipment manufacturer). If the assigned prior is not appropriate, the data will be un-necessarily surprising, which shows up as an un-necessarily low evidence value, which in turn takes longer (possibly hugely longer) to compute.

Particularly in electrospray, it is easy to choose a prior that is not appropriate. This is because a given mass M may carry charges Z varying over a substantial range, perhaps anywhere from 10 to 20 for a mass of 20000. A prior on this distribution is needed, because mock data must be predicted. Given that the charge states appear separately in the observed M/Z data, it might seem reasonable to assign a separate prior for each charge state e.g.:

$$\text{Prior for } (Z=10 \text{ and } Z=11 \text{ and} \ldots Z=20) = (\text{prior for } Z=10) \times (\text{prior for } Z=11) \times \ldots \times (\text{prior for } Z=20).$$

However, it then becomes very unlikely that a mass will appear with a low total signal strength, because all 11 individual strengths have to be small before the total can be small. This is not usually expected—real spectra usually have many weak signals and this, according to the prior, is extremely improbable. Hence nested sampling runs much too slowly, in practice freezing onto any of a variety of wrong answers.

It is better to use a two-stage prior for the signal strengths. First, a master prior is assigned to the total intensity I. In one embodiment this may be Cauchy:

$$\text{Prior } (I) \propto 1/(I^2+\text{constant})$$

With total intensity fixed, the subsidiary prior on charge state becomes a prior on the relative proportions assigned to specific charges. In one embodiment this may be uniform:

$$\text{Prior for } (Z=10 \text{ and } Z=11 \text{ and} \ldots Z=20 \text{ GIVEN } I) = \text{constant}.$$

In another embodiment, the charge-state signals could be correlated and/or weighted by charge. With this sort of two-stage prior, the algorithm no longer freezes inappropriately.

The immediate output from nested sampling is an ensemble of several dozen typical spectra, each in the form of a list of parent masses. These masses have intensities which are separately and plausibly distributed over charge. Just as in statistical mechanics (which helped to inspire nested sampling), the ensemble can be used to define mean properties together with fluctuations. In this way, nested-sampling results can be refined to a list of reliably inferred masses, with proper error bars expressing statistical uncertainty, and full knowledge of how each mass relates to the data.

Individual parent masses are accompanied by, maybe dominated by, their isotope distributions. In typical deconvolution, the isotopic composition of a given mass M is fixed at some ratio pattern:

Parent:Isotope#1:Isotope#2:

given by an average chemical composition. In the standard arrangement mock data is produced from trial parent masses by convolution with this mass-dependent isotope distribution, expanded to cover the charge states, and finally convolved with the instrumental peak shape.

Another complication in the analysis of mass spectral data is the presence of a variety of naturally occurring or artificially introduced isotopic variants of the elements comprising the molecules being analyzed. Furthermore, deviations from the assumed pattern can occur for particular compositions. These induce harmonic artefacts at wrong masses, as the probability factors try to fit the data better. In one arrangement a distribution:

Prior for (Parent, Isotope#1, Isotope#2, . . . )

of isotope proportions may be used. This distribution should be peaked around the average, but also allow appropriate flexibility.

For each dataset, an appropriate model of the instrumental peak shape corresponding to an isotopically pure species can be used. For example, a fixed full width at half maximum might be used for quadrupole data, whereas a fixed instrument resolution could be specified for TOF data.

In a further arrangement, the computation may be reformulated by using "importance sampling" to reduce the computational load. This statistical method has the side-effect of improving the accuracy and fidelity of the results obtained. In the original embodiment, each parent has a uniform prior over its mass:

$$\text{prior}(M)=\text{flat}$$

and the given likelihood Lhood(M) is used directly. If this is the only mass present, this likelihood yields the joint distribution:

$$\text{Joint}(M)=\text{prior}(M)\times L\text{hood}(M)$$

which represents the very simplest (single-parent) deconvolution.

But it is also possible to write:

$$\text{Joint}(M)=\text{density}(M)\times(\text{prior}(M)\times L\text{hood}(M)/\text{density}(M))$$

for arbitrary density. Instead of starting with the prior and applying the likelihood, it is also possible to start with the new density and apply the modified likelihood:

$$\text{Modified}(M)=\text{prior}(M)\times L\text{hood}(M)/\text{density}(M)$$

If the density removes structure from the likelihood and modifies it to something less sharp and spiky, this will reduce the computational load.

As it happens, there is a natural density to hand. Most mass spectrometry data is essentially linear, so that:

Mock data=(Linear matrix)·(Target masses)

Applying that linear matrix in reverse (as its transpose) to the real data yields a candidate:

density=(transpose of Linear matrix)·(real data)

This density is a doubly-blurred version of the true target, blurred once in the instrument and by the multiplicity of charge state, and again via the transpose. Nevertheless, the computational task of deconvolving it is often very much less than having to start from scratch, with a flat prior. Such a program runs much more quickly and precisely.

In another arrangement, the data being deconvoluted may come from a TOF, Quadrupole, FTICR, Orbitrap, Magnetic sector, 3D Ion trap or Linear ion trap. In each of these instances, an appropriate model of peak shape and width as a function of mass to charge ratio and intensity should be used.

In a further arrangement, the data being deconvolved may be produced from ions generated by an ion source from ESI, ETD etc.

In each of these instances, the distribution of charge states is characteristic of the technique. For example, ions produced by MALDI ionization are usually singly charged, while electrospray produces a distribution over a large range of charge states for large molecules.

In a yet further arrangement, the data being processed may be from species that have been separated using a separation device selected from the group including but not limited to: LC, GC, IMS, CE, FAIMS or combinations of these or any other suitable separation device. In each case, the distribution over the extra analytical dimensions is treated similarly to the distribution over charge states as described above.

In a still further arrangement, the data being deconvolved may be produced from a sample containing proteins, peptides, oligonucleotides, carbohydrates, phosphopeptides, and fragments or a mixture of these. In each case, the isotope model or models employed should reflect the composition of the type of sample being analyzed. As part of this embodiment, trial masses may be assigned individual molecule types.

Although the present invention has been described with reference to the preferred embodiments, it will be understood by those skilled in the art that various changes in form and detail may be made without departing from the scope of the invention as set forth in the accompanying claims.

The invention claimed is:

1. A mass spectrometer comprising:

a gas phase ion-neutral reaction device; and a control system for controlling said gas phase ion-neutral reaction device;

said control system being arranged and adapted to automatically and repeatedly vary a residence time of ions within said gas phase ion-neutral reaction device so that in a first mode of operation ions are arranged to have a relatively long average residence time T1 so that at least some parent or precursor ions are caused to react within said gas phase ion-neutral reaction device and wherein in a second mode of operation ions are arranged to have a relatively short, non-zero residence time T2 so that substantially fewer or no parent or precursor ions are caused to react within said gas phase ion-neutral reaction device, wherein T1 is greater than T2; and wherein said control system is arranged and adapted to switch either said gas phase ion-neutral reaction device or said mass spectrometer back and forth between said first and second modes of operation at least once every 0.1, 0.2, 0.3, 0.4, 0.5, 0.6, 0.7, 0.8, 0.9, 1 or 5 seconds.

2. A mass spectrometer as claimed in claim 1, wherein said gas phase ion-neutral reaction device is arranged and adapted to perform gas phase hydrogen-deuterium exchange.

3. A mass spectrometer as claimed in claim 2, wherein in said first mode of operation at least some parent or precursor ions are caused to become deuterated within said gas phase ion-neutral reaction device and wherein in said second mode of operation substantially fewer or no parent or precursor ions are caused to become deuterated.

4. A mass spectrometer as claimed in claim 2, further comprising a device for supplying a reagent gas or vapour to said gas phase ion-neutral reaction device and wherein said reagent gas or vapour is selected from the group consisting of: (i) deuterated ammonia or $ND_3$; (ii) deuterated methanol or $CD_3OD$; (iii) deuterated water or $D_2O$; and (iv) deuterated hydrogen sulphide or $D_2S$.

5. A mass spectrometer as claimed in claim 1, wherein said gas phase ion-neutral reaction device is arranged and adapted to perform ozonolysis.

6. A mass spectrometer as claimed in claim 1, wherein said gas phase ion-neutral reaction device is selected from the group consisting of:

(i) an ion tunnel or ion funnel device comprising a plurality of electrodes each comprising an aperture or forming an ion guide region through which ions are transmitted in use;

(ii) a multipole rod set device; or (iii) a plurality of planar electrodes arranged in a plane in which ions are generally transmitted through said device.

7. A mass spectrometer as claimed in claim 1, wherein said gas phase ion-neutral reaction device comprises a plurality of electrodes and wherein one or more transient DC voltages or waveforms are applied to said electrodes.

8. A mass spectrometer as claimed in claim 7, wherein:

in said first mode of operation said control system is arranged and adapted to set an amplitude or speed at which said one or more transient DC voltages or waveforms are applied to said electrodes so that an average residence time of parent or precursor ions within said gas phase ion-neutral reaction device is T1; and wherein in said second mode of operation said control system is arranged and adapted to set an amplitude or speed at which said one or more transient DC voltages or waveforms are applied to said electrodes so that the average residence time of parent or precursor ions within said gas phase ion-neutral reaction device is T2, wherein T2<T1.

9. A mass spectrometer as claimed in claim 1, wherein said control system is arranged and adapted:

(i) to cause parent or precursor ions which have undergone a reaction in said gas phase ion-neutral reaction device and which emerge from said gas phase ion-neutral reaction device in said first mode of operation to be mass analysed to form a first mass spectrum or first mass spectral data;

(ii) to cause parent or precursor ions which have not undergone a reaction in said gas phase ion-neutral reaction device and which emerge from said gas phase ion-neutral reaction device in said second mode of operation to be mass analysed to form a second mass spectrum or second mass spectral data; and (iii) to compare said first mass spectrum or first mass spectral data with said second mass spectrum or second mass spectral data.

10. A mass spectrometer as claimed in claim 1, further comprising a fragmentation device arranged downstream of said gas phase ion-neutral reaction device, wherein said fragmentation device is arranged and adapted to fragment ions emerging from said gas phase ion-neutral reaction device in said first mode of operation or said second mode of operation.

11. A mass spectrometer as claimed in claim 10, wherein said fragmentation device comprises an Electron Transfer Dissociation ("ETD") fragmentation device, an Electron Capture Dissociation ("ECD") fragmentation device or a Collision Induced Dissociation ("CID") fragmentation device.

12. A mass spectrometer as claimed in claim 10, wherein said gas phase ion-neutral reaction device is arranged and adapted to perform gas phase hydrogen-deuterium exchange, and wherein said control system is arranged and adapted:

(i) to cause deuterated fragment ions which emerge from said fragmentation device to be mass analysed to form a third mass spectrum or third mass spectral data;

(ii) to cause non-deuterated fragment ions which emerge from said fragmentation device to be mass analysed to form a fourth mass spectrum or fourth mass spectral data; and (iii) to compare said third mass spectrum or third mass spectral data with said fourth mass spectrum or fourth mass spectral data.

13. A mass spectrometer as claimed in claim 2, wherein said control system is arranged and adapted:

(i) to correlate deuterated parent or precursor ions with corresponding non-deuterated parent or precursor ions based on an LC elution time or an ion mobility drift time; or (ii) to correlate deuterated fragment ions or non-deuterated fragment ions with corresponding deuterated parent or precursor ions or non-deuterated parent or precursor ions based on an LC elution time or an ion mobility drift time.

14. A mass spectrometer as claimed in claim 1, further comprising a device for separating ions located upstream from said gas phase ion-neutral reaction device.

15. A method of mass spectrometry comprising:

performing gas phase ion-neutral reactions on ions in a gas phase ion-neutral reaction device;

automatically and repeatedly varying a residence time of ions within said gas phase ion-neutral reaction device so that in a first mode of operation ions are arranged to have a relatively long average residence time T1 so that at least some parent or precursor ions are caused to react within said gas phase ion-neutral reaction device and wherein in a second mode of operation ions are arranged to have a relatively short, non-zero residence time T2 so that substantially fewer or no parent or precursor ions are caused to react within said gas phase ion-neutral reaction, wherein T1 is greater than T2; and switching back and forth between said first and second modes of operation at least once every 0.1, 0.2, 0.3, 0.4, 0.5, 0.6, 0.7, 0.8, 0.9, 1 or 5 seconds.

16. A mass spectrometer comprising:

a gas phase ion-neutral reaction device, wherein said gas phase ion-neutral reaction device is arranged and adapted to perform gas phase hydrogen-deuterium exchange; and a control system for controlling said gas phase ion-neutral reaction device;

said control system being arranged and adapted to automatically and repeatedly vary a residence time of ions within said gas phase ion-neutral reaction device so that in a first mode of operation ions are arranged to have a relatively long average residence time T1 so that at least some parent or precursor ions are caused to react within said gas phase ion-neutral reaction device and wherein in a second mode of operation ions are arranged to have a relatively short or zero residence time T2 so that substantially fewer or no parent or precursor ions are caused to react within said gas phase ion-neutral reaction device, wherein T1 is greater than T2;

wherein said control system is arranged and adapted to switch either said gas phase ion-neutral reaction device or said mass spectrometer back and forth between said first and second modes of operation at least once every 0.1, 0.2, 0.3, 0.4, 0.5, 0.6, 0.7, 0.8, 0.9, 1 or 5 seconds; and wherein said control system is arranged and adapted: (i) to correlate deuterated parent or precursor ions with corresponding non-deuterated parent or precursor ions based on an LC elution time or an ion mobility drift time; or (ii) to correlate deuterated fragment ions or non-deuterated fragment ions with corresponding deuterated parent or precursor ions or non-deuterated parent or precursor ions based on an LC elution time or an ion mobility drift time.

* * * * *